US008543046B2

(12) United States Patent
Seo et al.

(10) Patent No.: US 8,543,046 B2
(45) Date of Patent: Sep. 24, 2013

(54) FIXING DEVICE, IMAGE FORMING APPARATUS INCORPORATING SAME, AND FIXING METHOD

(75) Inventors: Hiroshi Seo, Kanagawa (JP); Masanao Ehara, Kanagawa (JP); Tadashi Ogawa, Tokyo (JP); Satoshi Ueno, Tokyo (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 13/161,929

(22) Filed: Jun. 16, 2011

(65) Prior Publication Data

US 2011/0311284 A1 Dec. 22, 2011

(30) Foreign Application Priority Data

Jun. 21, 2010 (JP) ..... 2010-140508

(51) Int. Cl.
*G03G 15/20* (2006.01)

(52) U.S. Cl.
USPC ..... 399/338; 329/329

(58) Field of Classification Search
USPC ..... 335/67, 65, 118, 170, 185, 189, 190, 335/192, 194
See application file for complete search history.

(56) References Cited

U.S. PATENT DOCUMENTS 5,832,354 A 11/1998 Kouno et al.
5,915,147 A 6/1999 Kouno et al.
6,219,520 B1 4/2001 Ehara
6,560,421 B1 5/2003 Matsumoto
6,628,916 B2 9/2003 Yasui et al.
6,636,709 B2 10/2003 Furukawa et al.
6,778,790 B2 8/2004 Yoshinaga et al.
6,785,505 B2 8/2004 Yasui et al.
6,807,386 B2 10/2004 Yasui et al.
6,881,927 B2 4/2005 Yoshinaga et al.
6,892,044 B2 5/2005 Yasui et al.

(Continued)

FOREIGN PATENT DOCUMENTS

JP 2975435 9/1999
JP 2003-337490 11/2003

(Continued)

OTHER PUBLICATIONS

Extended Search Report issued Aug. 29, 2011 in Europeanl Application No. 11169961.7.

(Continued)

*Primary Examiner* — Clayton E Laballe
*Assistant Examiner* — Victor Verbitsky
(74) *Attorney, Agent, or Firm* — Oblon, Spivak, McClelland, Maier & Neustadt, L.L.P.

(57) ABSTRACT

A fixing device includes a fixing rotary body to rotate in a predetermined direction of rotation and a pressing rotary body pressed against the fixing rotary body to rotate in a direction counter to the direction of rotation of the fixing rotary body and form a nip therebetween through which a recording medium bearing a toner image passes. A heat generator is disposed opposite the fixing rotary body at a section other than the nip to heat the fixing rotary body. A moving assembly is disposed opposite the heat generator to generate a magnetic force to move the heat generator with respect to the fixing rotary body so as to change one of a pressure and a distance between the heat generator and the fixing rotary body.

15 Claims, 5 Drawing Sheets

(56) References Cited

U.S. PATENT DOCUMENTS

| | | | | |
|---|---|---|---|---|
| 7,022,944 | B2 | 4/2006 | Yoshinaga et al. | |
| 7,266,336 | B2 | 9/2007 | Ueno et al. | |
| 7,450,872 | B2 | 11/2008 | Ueno et al. | |
| 7,491,917 | B2 | 2/2009 | Ueno | |
| 7,509,085 | B2 | 3/2009 | Yoshinaga et al. | |
| 7,546,049 | B2 | 6/2009 | Ehara et al. | |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,742,714 | B2 | 6/2010 | Shinshi et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 7,925,177 | B2 | 4/2011 | Ishii et al. | |
| 2006/0245797 | A1 | 11/2006 | Suzuki | |
| 2006/0257183 | A1 | 11/2006 | Ehara et al. | |
| 2006/0285893 | A1 | 12/2006 | Ishii | |
| 2007/0003334 | A1 | 1/2007 | Shinshi et al. | |
| 2007/0014600 | A1* | 1/2007 | Ishii et al. | 399/328 |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0317532 | A1 | 12/2008 | Ehara et al. | |
| 2009/0060550 | A1 | 3/2009 | Seo | |
| 2009/0123201 | A1 | 5/2009 | Ehara et al. | |
| 2009/0142114 | A1 | 6/2009 | Yasuda et al. | |
| 2009/0148204 | A1 | 6/2009 | Yoshinaga et al. | |
| 2009/0148205 | A1 | 6/2009 | Seo et al. | |
| 2009/0245897 | A1 | 10/2009 | Seo et al. | |
| 2010/0074667 | A1 | 3/2010 | Ehara et al. | |
| 2010/0158553 | A1 | 6/2010 | Ueno | |
| 2010/0178088 | A1* | 7/2010 | Koshida et al. | 399/328 |
| 2010/0303521 | A1 | 12/2010 | Ogawa et al. | |
| 2011/0044706 | A1 | 2/2011 | Iwaya et al. | |
| 2011/0052277 | A1 | 3/2011 | Ueno et al. | |
| 2011/0064450 | A1 | 3/2011 | Ishii et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0091253 | A1 | 4/2011 | Seo et al. | |

FOREIGN PATENT DOCUMENTS

| | | |
|---|---|---|
| JP | 3998955 | 8/2007 |
| JP | 2008-76794 | 4/2008 |
| JP | 2009-258453 | 11/2009 |
| SU | 1293745 | * 2/1987 |

OTHER PUBLICATIONS

U.S. Appl. No. 13/026,945, filed Feb. 14, 2011, Kenji Ishii et al.
U.S. Appl. No. 13/041,703, filed Mar. 7, 2011, Tadashi Ogawa et al.
U.S. Appl. No. 13/064,201, filed Mar. 10, 2011.
U.S. Appl. No. 13/064,137, filed Mar. 8, 2011.
U.S. Appl. No. 13/064,105, filed Mar. 7, 2011.
U.S. Appl. No. 12/974,852, filed Dec. 21, 2010.
U.S. Appl. No. 13/049,330, filed Mar. 16, 2011, Satoshi Ueno et al.
U.S. Appl. No. 13/049,181, filed Mar. 16, 2011, Masanao Ehara et al.

* cited by examiner

FIXING DEVICE, IMAGE FORMING APPARATUS INCORPORATING SAME, AND FIXING METHOD

CROSS-REFERENCE TO RELATED APPLICATIONS

The present application is based on and claims priority to Japanese Patent Application No. 2010-140508, filed on Jun. 21, 2010, in the Japan Patent Office, which is hereby incorporated herein by reference in its entirety.

BACKGROUND OF THE INVENTION

1. Field of the Invention

Exemplary aspects of the present invention relate to a fixing device, an image forming apparatus, and a fixing method, and more particularly, to a fixing device for fixing a toner image on a recording medium, an image forming apparatus including the fixing device, and a fixing method for fixing a toner image on a recording medium.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing belt formed into a loop and a pressing roller pressed against the fixing belt to form a nip therebetween through which the recording medium bearing the toner image passes.

For example, Japanese patent publication no. JP-2002-251084-A proposes a configuration in which the fixing belt is stretched over and rotated around a rotatable fixing roller and a stationary heat generator (e.g., a resistance heat generator) and the pressing roller disposed outside the loop formed by the fixing belt is pressed against the fixing roller via the fixing belt to form the nip between the fixing belt and the pressing roller through which the recording medium bearing the toner image passes. With this configuration, the heat generator contacting the inner circumferential surface of the fixing belt heats the fixing belt; the fixing roller contacting the inner circumferential surface of the fixing belt rotates the fixing belt which in turn rotates the pressing roller by friction therebetween. As the fixing belt and the pressing roller rotate and convey the recording medium through the nip, they apply heat and pressure to the recording medium to fix the toner image on the recording medium. The fixing belt includes a ferromagnet that is attracted by a magnet of the heat generator, thus the fixing belt is adhered to the heat generator precisely with no gap therebetween, to improve heating efficiency of the fixing belt.

As another example, Japanese patent publication no. JP-2009-258453-A proposes a configuration in which the looped fixing belt is sandwiched between a heat generator (e.g., a temperature sensitive element) disposed inside the loop formed by the fixing belt and an exciting coil unit disposed outside the loop formed by the fixing belt. The heat generator contacts or is disposed opposite the inner circumferential surface of the fixing belt with a slight gap therebetween. As the heat generator generates heat by a magnetic flux from the exciting coil unit by electromagnetic induction, it heats the fixing belt.

However, the above-described configurations have a drawback in that the heat generator constantly contacting or disposed opposite the fixing belt may heat the fixing belt even in a standby mode in which the fixing belt is not rotated, resulting in localized overheating of the fixing belt. Accordingly, when a fixing process is started, the locally heated fixing belt, with a temperature not uniform and stable but instead varying in the direction of rotation of the fixing belt, may generate faulty fixing of the toner image on the recording medium.

BRIEF SUMMARY OF THE INVENTION

This specification describes below an improved fixing device. In one exemplary embodiment of the present invention, the fixing device includes a fixing rotary body to rotate in a predetermined direction of rotation and a pressing rotary body pressed against the fixing rotary body to rotate in a direction counter to the direction of rotation of the fixing rotary body and form a nip therebetween through which a recording medium bearing a toner image passes. A heat generator is disposed opposite the fixing rotary body at a section other than the nip to heat the fixing rotary body. A moving assembly is disposed opposite the heat generator to generate a magnetic force to move the heat generator with respect to the fixing rotary body so as to change one of a pressure and a distance between the heat generator and the fixing rotary body.

This specification further describes an improved image forming apparatus. In one exemplary embodiment, the image forming apparatus includes the fixing device described above.

This specification further describes an improved fixing method for fixing a toner image on a recording medium and including the steps of rotating a fixing rotary body in a predetermined direction of rotation; pressing a pressing rotary body against the fixing rotary body to rotate the pressing rotary body in a direction counter to the direction of rotation of the fixing rotary body and form a nip therebetween through which the recording medium bearing the toner image passes; heating the fixing rotary body with a heat generator disposed opposite the fixing rotary body at a section other than the nip; and moving the heat generator with respect to the fixing rotary body to change one of a pressure and a distance between the heat generator and the fixing rotary body with a moving assembly disposed opposite the heat generator and generating a magnetic force.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
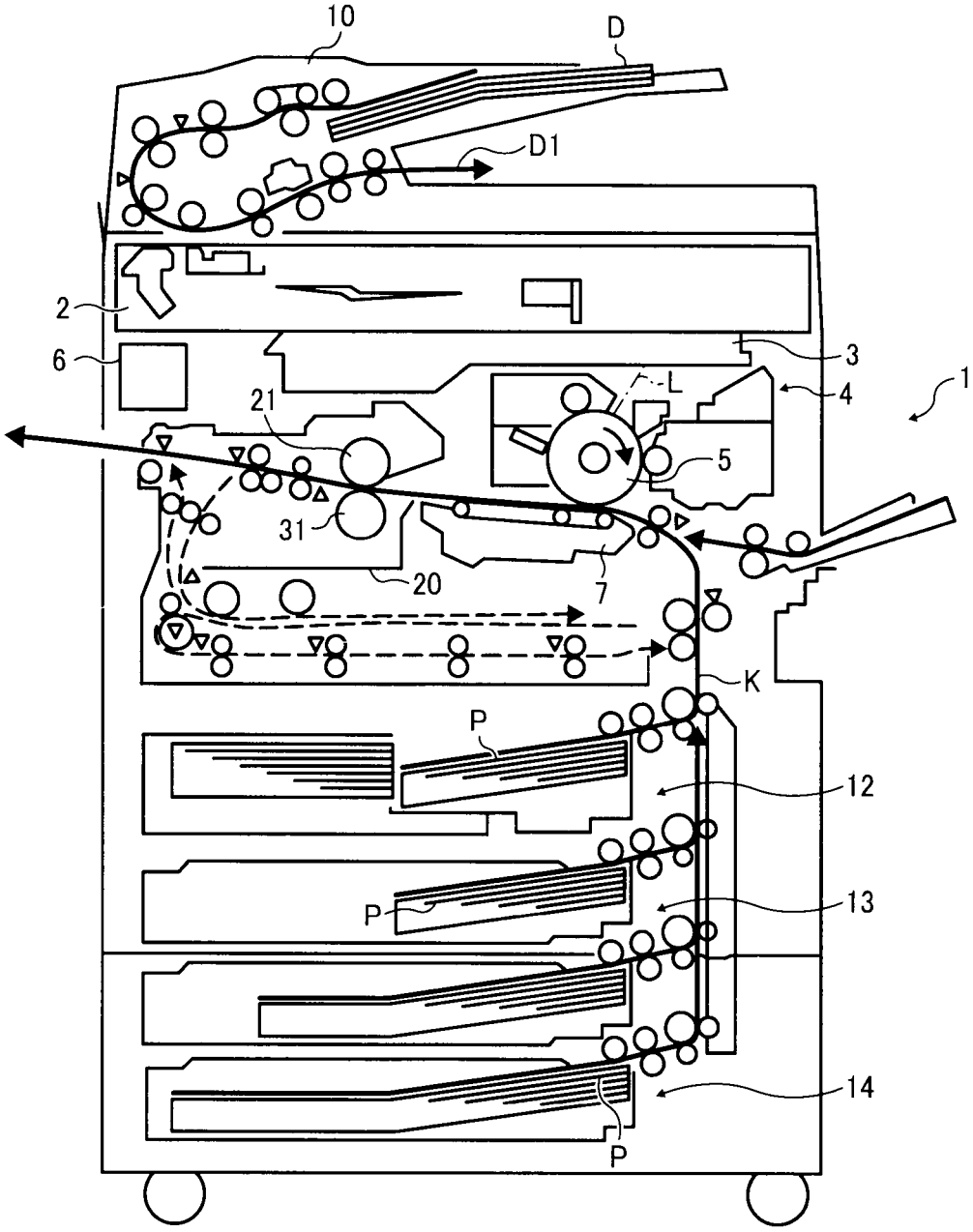
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a copier for forming an image on a recording medium.

Referring to FIG. 1, the following describes the structure of the image forming apparatus 1.

As illustrated in FIG. 1, the image forming apparatus 1 includes an auto document feeder 10, disposed atop the image forming apparatus 1, which feeds an original document D bearing an original image placed thereon to an original document reader 2 disposed below the auto document feeder 10. The original document reader 2 optically reads the original image on the original document D to generate image data and sends it to an exposure device 3 disposed below the original document reader 2. The exposure device 3 emits light L onto a photoconductive drum 5 of an image forming device 4 disposed below the exposure device 3 according to the image data sent from the original document reader 2 to form an electrostatic latent image on the photoconductive drum 5. Thereafter, the image forming device 4 renders the electrostatic latent image formed on the photoconductive drum 5 visible as a toner image with developer (e.g., toner).

Below the image forming device 4 is a transfer device 7 that transfers the toner image formed on the photoconductive drum 5 onto a recording medium P sent from one of paper trays 12, 13, and 14, each of which loads a plurality of recording media P (e.g., transfer sheets), disposed in a lower portion of the image foiling apparatus 1 below the transfer device 7. The recording medium P bearing the transferred toner image is sent to a fixing device 20 disposed downstream from the transfer device 7 in a recording medium conveyance direction, where a fixing belt 21 and a pressing roller 31 disposed opposite each other apply heat and pressure to the recording medium P, thus fixing the toner image on the recording medium P.

Referring to FIG. 1, the following describes the operation of the image forming apparatus 1 having the above-described structure.

An original document D bearing an original image, placed on an original document tray of the auto document feeder 10 by a user, is conveyed by a plurality of conveyance rollers of the auto document feeder 10 in a direction D1 above the original document reader 2. As the original document D passes over an exposure glass of the original document reader 2, the original document reader 2 optically reads the original image on the original document D to generate image data.

The image data is converted into an electric signal and then sent to the exposure device 3. The exposure device 3, serving as an image writer, emits light L (e.g., a laser beam) onto the photoconductive drum 5 of the image forming device 4 according to the electric signal, thus writing an electrostatic latent image on the photoconductive drum 5.

The image forming device 4 performs a plurality of image forming processes as the photoconductive drum 5 rotates clockwise in FIG. 1: a charging process, an exposure process, and a development process. In the charging process, a charger of the image forming device 4 charges an outer circumferential surface of the photoconductive drum 5, accordingly the exposure device 3 emits light L onto the charged outer circumferential surface of the photoconductive drum 5 to form an electrostatic latent image thereon as described above in the exposure process. Thereafter, in the development process, a development device of the image forming device 4 develops the electrostatic latent image formed on the photoconductive drum 5 into a toner image with toner.

At the same time, a recording medium P is sent to a transfer nip formed between the photoconductive drum 5 and the transfer device 7 from one of the plurality of paper trays 12, 13, and 14, which is selected manually by the user using a control panel disposed atop the image forming apparatus 1 or automatically by an electric signal of a print request sent from a client computer. If the paper tray 12 is selected, for example, an uppermost recording medium P of a plurality of recording media P loaded in the paper tray 12 is conveyed to a registration roller pair disposed in a conveyance path K extending from each of the paper trays 12, 13, and 14 to the transfer device 7.

When the uppermost recording medium P reaches the registration roller pair, it is stopped by the registration roller pair temporarily and then conveyed to the transfer nip formed between the photoconductive drum 5 and the transfer device 7 at a time when the toner image formed on the photoconductive drum 5 is transferred onto the uppermost recording medium P by the transfer device 7.

After the transfer of the toner image onto the recording medium P, the recording medium P bearing the toner image is sent to the fixing device 20 through a conveyance path extending from the transfer device 7 to the fixing device 20. As the recording medium P passes through a fixing nip formed between the fixing belt 21 and the pressing roller 31 of the fixing device 20, it receives heat from the fixing belt 21 and pressure from the fixing belt 21 and the pressing roller 31, which fix the toner image on the recording medium P. Thereafter, the recording medium P bearing the fixed toner image is discharged from the fixing nip to an outside of the image forming apparatus 1, thus completing a series of image forming processes.

Figure 2:
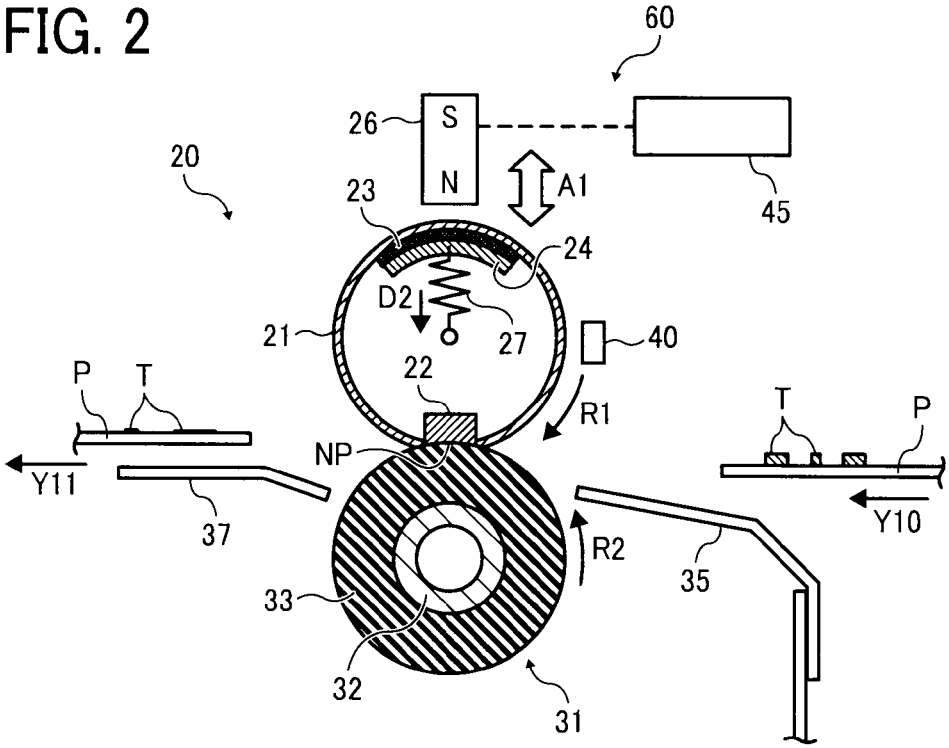
FIG. 2 is a vertical sectional view of a fixing device included in the image forming apparatus shown in FIG. 1.
Figure 3A:
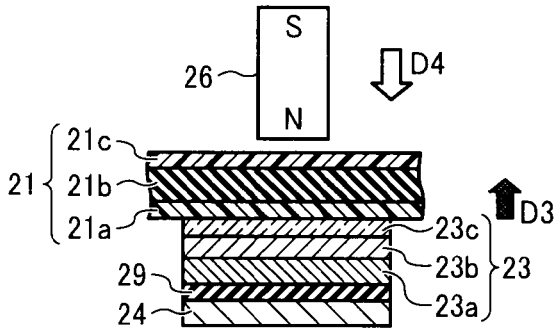
FIG. 3A is a partially enlarged vertical sectional view of a fixing belt included in the fixing device shown in FIG. 2 in a state in which the fixing belt is rotated.
Figure 3B:
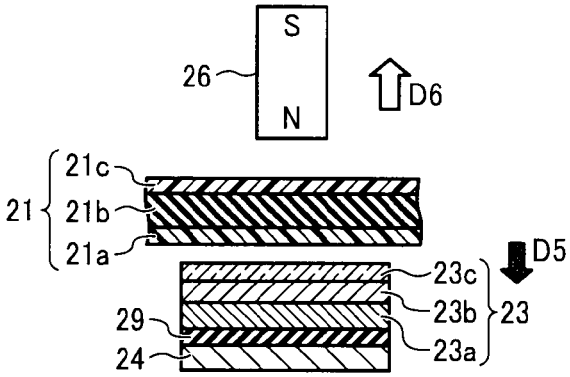
FIG. 3B is a partially enlarged vertical sectional view of the fixing belt included in the fixing device shown in FIG. 2 in a state in which the fixing belt is not rotated.

Referring to FIGS. 2, 3A, and 3B, the following describes the structure and operation of the fixing device 20 installed in the image forming apparatus 1 described above.

FIG. 2 is a vertical sectional view of the fixing device 20. FIG. 3A is a partially enlarged vertical sectional view of the fixing belt 21 of the fixing device 20 in a state in which the fixing belt 21 is rotated. FIG. 3B is a partially enlarged vertical sectional view of the fixing belt 21 in a state in which the fixing belt 21 is not rotated. FIGS. 3A and 3B also illustrate multiple layers of the fixing belt 21 and a heat generator 23 of the fixing device 20.

As illustrated in FIG. 2, the fixing device 20 includes the fixing belt 21 formed into a loop; a nip formation pad 22, the heat generator 23, a magnetic member 24, and a tension spring 27, which are disposed inside the loop formed by the fixing belt 21; and a permanent magnet 26, the pressing roller 31, guides 35 and 37, a temperature sensor 40, and a driver 45, which are disposed outside the loop formed by the fixing belt 21.

The fixing belt 21 is a flexible, thin, endless belt serving as a fixing member or a fixing rotary body that rotates or moves clockwise in FIG. 2 in a rotation direction R1. As illustrated in FIG. 3A, the fixing belt 21, having a thickness not greater than about 1 mm and a loop diameter of about 40 mm when assuming its operative looped shape, is constructed of a base layer 21*a*; an elastic layer 21*b* disposed on the base layer 21*a*; and a release layer 21*c* disposed on the elastic layer 21*b*.

The base layer 21*a* constitutes an inner circumferential surface of the fixing belt 21, that is, a contact face sliding over the nip formation pad 22 and the heat generator 23 disposed inside the loop formed by the fixing belt 21. The base layer 21*a* has a thickness of about 200 μm and is made of polyimide (PI).

The elastic layer 21*b*, made of a rubber material such as silicon rubber, silicon rubber form, and/or fluorocarbon rubber, has a thickness in a range of from about 100 μm to about 300 μm. The elastic layer 21*b* eliminates or reduces slight surface asperities of the fixing belt 21 at a nip NP formed between the fixing belt 21 and the pressing roller 31. Accordingly, heat is uniformly transmitted from the fixing belt 21 to a toner image T on a recording medium P passing through the nip NP, minimizing formation of a rough image such as an orange peel image. According to this exemplary embodiment, silicon rubber with a thickness of about 150 μm is used as the elastic layer 21*b*.

The release layer 21*c* has a thickness in a range of from about 10 μm to about 50 μm, and is made of tetrafluoroethylene-perfluoroalkylvinylether copolymer (PFA), polytetrafluoroethylene (PTFE), polyimide, polyetherimide, and/or polyether sulfide (PES). The release layer 21*c* releases or separates the toner image T from the fixing belt 21. According to this exemplary embodiment, the release layer 21*c* has a thickness of about 30 μm and is made of PFA.

Inside the loop formed by the fixing belt 21 are disposed the nip formation pad 22, the heat generator 23, the magnetic member 24, the tension spring 27, and an insulator 29 depicted in FIGS. 2 and 3A. Outside the loop formed by the fixing belt 21 is the permanent magnet 26 disposed opposite the fixing belt 21 with a predetermined gap between the permanent magnet 26 and a part of an outer circumferential surface of the fixing belt 21. A lubricant is applied to the inner circumferential surface of the fixing belt 21 to reduce friction between an outer circumferential surface of the nip formation pad 22 and the heat generator 23 and the inner circumferential surface of the fixing belt 21 sliding over the nip formation pad 22 and the heat generator 23.

The nip formation pad 22 contacting the inner circumferential surface of the fixing belt 21 is a stationary member fixedly disposed inside the loop formed by the fixing belt 21; thus, the rotating fixing belt 21 slides over the stationary, nip formation pad 22. Further, the nip formation pad 22 presses against the pressing roller 31 via the fixing belt 21 to form the nip NP between the fixing belt 21 and the pressing roller 31 through which the recording medium P bearing the toner image T passes. Lateral ends of the nip formation pad 22 in a longitudinal direction thereof parallel to an axial direction of the fixing belt 21 are mounted on and supported by side plates of the fixing device 20, respectively. The nip formation pad 22 is made of a rigid material that prevents substantial bending of the nip formation pad 22 by pressure applied from the pressing roller 31.

The nip formation pad 22 is constituted by an opposed face (e.g., a contact face that contacts the inner circumferential surface of the fixing belt 21 sliding over the nip formation pad 22) facing the pressing roller 31 and having a concave shape corresponding to the curvature of the pressing roller 31. The recording medium P moves along the concave opposed face of the nip formation pad 22 in conformity with the curvature of the pressing roller 31 and is discharged from the nip NP in a direction Y11. Thus, the concave shape of the nip formation pad 22 prevents the recording medium P bearing the fixed toner image T from adhering to the fixing belt 21, thereby facilitating separation of the recording medium P from the fixing belt 21.

As described above, according to this exemplary embodiment, the nip formation pad 22 has a concave shape to form the concave nip NP. Alternatively, the nip formation pad 22 may have a flat, planar shape to form a planar nip NP. Specifically, the opposed face of the nip formation pad 22 disposed opposite the pressing roller 31 may have a flat, planar shape. Accordingly, the planar nip NP formed by the planar opposed face of the nip formation pad 22 is substantially parallel to an imaged side of the recording medium P. Consequently, the fixing belt 21 pressed by the planar opposed face of the nip formation pad 22 is precisely adhered to the recording medium P to improve fixing performance. Further, the increased curvature of the fixing belt 21 at an exit of the nip NP facilitates separation of the recording medium P discharged from the nip NP from the fixing belt 21.

As illustrated in FIG. 2, the substantially semi-cylindrical heat generator 23 is disposed opposite the permanent magnet 26 via the fixing belt 21 at a section of the fixing belt 21 other than the nip NP. In the present embodiment, the heat generator 23 and the permanent magnet 26 are disposed directly opposite the nip NP, although their location is not limited thereto. In this case, the heat generator 23 separably contacts the inner circumferential surface of the fixing belt 21. Shafts protruding from lateral ends of the heat generator 23 in a longitudinal direction thereof parallel to the axial direction of the fixing belt 21, respectively, engage slots provided in the side plates of the fixing device 20 via bearings, respectively, to slidably support the heat generator 23 in a diametrical direction of the fixing belt 21.

As noted above and illustrated in FIG. 3A, the heat generator 23 is constructed of multiple layers: a base layer 23*a* constituting an inner circumferential surface disposed opposite the insulator 29; a heat generation layer 23*b*, including a resistance heat generator, disposed on the base layer 23*a*; and a protective layer 23*c*, that is, an insulating layer disposed on the heat generation layer 23*b*. According to this exemplary embodiment, the heat generator 23 has a length of about 320 mm in the longitudinal direction thereof and a length, that is, an arcuate length, of about 10 mm in a circumferential direction thereof. In the present embodiment, the base layer 23*a* is made of aluminum oxide (alumina) and/or aluminum nitride. The heat generation layer 23*b* is made of a resistance heat generator, that is, a laminated heat generator made of ceramic. Lateral ends of the heat generation layer 23*b* in a longitudinal direction thereof parallel to the axial direction of the fixing belt 21 are connected to a power source. When the heat generation layer 23*b* is supplied with an electric current, it is heated by its electric resistance, thus heating the fixing belt 21 that either contacts or is disposed opposite the heat generator 23. It is to be noted that the heat generation layer 23*b* may be any device capable of generating heat, such as a metal dispersion resin with an adjusted resistance.

The protective layer 23*c* is made of an insulating material, such as glass, that prevents the electric current applied to the heat generator 23 from flowing to the fixing belt 21. The base layer 23*a* of the heat generator 23 is mounted with the magnetic member 24 via the insulator 29.

With the above-described configuration, the heat generator 23 generates heat by itself, conducting the heat therefrom to the fixing belt 21. Then, the heat is applied from the outer circumferential surface of the heated fixing belt 21 to a toner image T on a recording medium P depicted in FIG. 2 as the recording medium P passes through the nip NP formed between the fixing belt 21 and the pressing roller 31.

The temperature sensor 40, disposed opposite the outer circumferential surface of the fixing belt 21, serves as a temperature detector that detects a temperature of the outer circumferential surface of the fixing belt 21. The temperature sensor 40 may be for example, a thermistor, a thermopile, or the like. Based on the temperature detected by the temperature sensor 40, a controller 6 depicted in FIG. 1, that is, a central processing unit (CPU) provided with a random-access memory (RAM) and a read-only memory (ROM), for example, controls output of the power source that applies the electric current to the heat generator 23, thus adjusting the temperature of the fixing belt 21 to a desired fixing temperature.

As described above, according to this exemplary embodiment, the heat generator 23 has multiple layers including the heat generation layer 23*b*. Alternatively, the heat generator 23 may have a single layer, that is, the heat generation layer 23*b* only.

As illustrated in FIGS. 2, 3A, and 3B, the permanent magnet 26 is disposed opposite the magnetic member 24 via the fixing belt 21 and the heat generator 23. The permanent magnet 26 may be a ferromagnetic magnet, for example, a rare-earth magnet or a magnet made of a hard magnetic material such as neodymium-iron-boron alloy.

The permanent magnet 26 is slidably moved over a frame of the fixing device 20, for example, by the driver 45 bidirectionally as indicated by the double-headed arrow A1 in FIG. 2 to change a distance between the permanent magnet 26 and the magnetic member 24. As the driver 45 moves the permanent magnet 26 in the diametrical direction of the fixing belt 21, the permanent magnet 26 alternately applies or ceases to apply a magnetic force to the magnetic member 24 or changes a magnitude of the magnetic force exerted on the magnetic member 24, thus moving the heat generator 23 together with the magnetic member 24 in the diametrical direction of the fixing belt 21, a detailed description of which is deferred.

The driver 45 that moves the permanent magnet 26 may be a mechanism that includes a cam contacting the permanent magnet 26 biased upward in FIG. 2 by a spring.

Optionally, a fan that cools the permanent magnet 26 may be added to minimize the decrease in magnetic permeability due to the heated permanent magnet 26.

As illustrated in FIG. 2, the substantially semi-cylindrical magnetic member 24 is attached to the heat generator 23 and is disposed opposite the fixing belt 21 via the heat generator 23. The magnetic member 24 may be made of soft ferrite, but preferably is made of hard ferrite. The magnetic member 24 made of hard ferrite need to be disposed with respect to the permanent magnet 26 in such a manner that an attractive force is generated between the magnetic member 24 and the permanent magnet 26. For example, the south pole of the magnetic member 24 is disposed opposite the north pole of the permanent magnet 26, thus moving the heat generator 23 attached to the magnetic member 24 bidirectionally in the diametrical direction of the fixing belt 21 precisely by slidable movement of the permanent magnet 26, a detailed description of which is deferred.

As illustrated in FIG. 3A, the insulator 29 is provided between the heat generator 23 and the magnetic member 24. The insulator 29, made of an insulating material such as sponge rubber or urethane rubber, minimizes the decrease in magnetic permeability due to the heated magnetic member 24 by heat conduction from the heat generator 23 to the magnetic member 24.

With the above-described configuration of the insulator 29 combined with the heat generator 23 and the magnetic member 24, in accordance with the bidirectional movement of the permanent magnet 26 as indicated by the double-headed arrow A1 in FIG. 2, the insulator 29 also moves bidirectionally in the diametrical direction of the fixing belt 21 as indicated by the double-headed arrow A1 together with the heat generator 23 and the magnetic member 24.

As illustrated in FIG. 2, the tension spring 27 has one end in a longitudinal direction thereof which is attached to the heat generator 23, the magnetic member 24, and the insulator 29 and another end in the longitudinal direction thereof which is attached to a frame of the fixing device 20. Thus, the tension spring 27 serves as a biasing member that biases the magnetic member 24, the insulator 29, and the heat generator 23, against a magnetic force of the permanent magnet 26 to separate the heat generator 23 combined with the magnetic member 24 and the insulator 29 from the fixing belt 21 downward in FIG. 2 in a direction D2.

As illustrated in FIG. 2, the pressing roller 31 serves as a pressing rotary body that presses against the nip formation pad 22 via the fixing belt 21 by contacting the outer circumferential surface of the fixing belt 21 at the nip NP. The pressing roller 31 is constructed of a hollow metal core 32 and an elastic layer 33 disposed on the metal core 32. The elastic layer 33, having a thickness of about 3 mm, is made of silicon rubber form, silicon rubber, and/or fluorocarbon rubber.

Optionally, a thin surface release layer made of PFA and/or PTFE may be disposed on the elastic layer 33. With the above-described configuration, the pressing roller 31 is pressed against the nip formation pad 22 via the fixing belt 21 to form the desired nip NP between the pressing roller 31 and the fixing belt 21.

On the pressing roller 31 is mounted a gear engaging a driving gear of a driving mechanism that drives and rotates the pressing roller 31 counterclockwise in FIG. 2 in a rotation direction R2 counter to the rotation direction R1 of the fixing belt 21. Lateral ends of the pressing roller 31 in a longitudinal direction, that is, an axial direction thereof, are rotatably supported by the side plates of the fixing device 20 via bearings, respectively. Optionally, a heat source, such as a halogen heater, may be disposed inside the pressing roller 31.

With the elastic layer 33 of the pressing roller 31 made of a sponge material such as silicon rubber form, the pressing roller 31 applies decreased pressure to the nip formation pad 22 via the fixing belt 21 at the nip NP to decrease bending of the nip formation pad 22. Further, the pressing roller 31 provides increased heat insulation that minimizes heat conduction thereto from the fixing belt 21, improving heating efficiency of the fixing belt 21.

As a mechanism to convey the recording medium P bearing the toner image T to and from the nip NP formed between the fixing belt 21 and the pressing roller 31, the fixing device 20 includes two guide plates, the guide 35, that is, an entry guide plate, disposed at an entry to the nip NP and the guide 37, that is, an exit guide plate, disposed at an exit of the nip NP. The guide 35 is directed to the entry to the nip NP to guide the recording medium P conveyed in a direction Y10 from the transfer device 7 depicted in FIG. 1 to the nip NP. The guide 37 is directed to a conveyance path downstream from the fixing device 20 in the recording medium conveyance direction to guide the recording medium P discharged from the nip NP in the direction Y11 to the conveyance path. Both the guides 35 and 37 are mounted on the frame (e.g., a body) of the fixing device 20.

Referring to FIGS. 1 and 2, the following describes the operation of the fixing device 20 having the above-described structure.

When the image forming apparatus 1 is powered on, the power source supplies an electric current to the heat generator 23; at the same time, the pressing roller 31 starts rotating in the rotation direction R2. Accordingly, the fixing belt 21 rotates in accordance with rotation of the pressing roller 31 in the rotation direction R1 counter to the rotation direction R2 of the pressing roller 31 due to friction therebetween at the nip NP.

Thereafter, at the transfer nip formed between the photoconductive drum 5 and the transfer device 7, the toner image T formed on the photoconductive drum 5 as described above is transferred onto a recording medium P sent from one of the paper trays 12, 13, and 14. Being guided by the guide 35, the recording medium P bearing the toner image T is conveyed from the transfer nip in the direction Y10 toward the nip NP, entering the nip NP formed between the fixing belt 21 and the pressing roller 31 pressed against each other.

As the recording medium P bearing the toner image T passes through the nip NP, it receives heat from the heated fixing belt 21 and pressure from the fixing belt 21, the nip formation pad 22, and the pressing roller 31 that form the nip NP. Thus, the toner image T is fixed on the recording medium P by the heat and the pressure applied at the nip NP. Thereafter, the recording medium P bearing the fixed toner image T is discharged from the nip NP and conveyed in the direction Y11 as guided by the guide 37.

Referring to FIGS. 2, 3A, and 3B, the following describes the configuration of the fixing device 20 according to a first illustrative embodiment of the present invention.

As illustrated in FIG. 2, the fixing device 20 includes a moving assembly 60, constructed of the magnetic member 24, the permanent magnet 26, the tension spring 27, and the driver 45, which moves the heat generator 23 combined with the magnetic member 24 and the insulator 29 to change the pressure with which the heat generator 23 presses against the fixing belt 21 or, if separated from the fixing belt 21, a distance between the heat generator 23 and the fixing belt 21 disposed opposite the heat generator 23. For example, the moving assembly 60 moves the heat generator 23 bidirectionally in a direction D3 shown in FIG. 3A and a direction D5 shown in FIG. 3B.

As illustrated in FIG. 3A, the permanent magnet 26 is disposed opposite the magnetic member 24 via the fixing belt 21, the heat generator 23, and the insulator 29, and is slidably moved by the driver 45 depicted in FIG. 2 bidirectionally toward and away from the fixing belt 21, changing a distance between the permanent magnet 26 and the magnetic member 24. The magnetic member 24, together with the insulator 29, is attached to the heat generator 23 in such a manner that it is disposed opposite the fixing belt 21 via the insulator 29 and the heat generator 23. As illustrated in FIG. 2, the magnetic member 24 and the heat generator 23 are biased by the tension spring 27 in the direction D2 away from the fixing belt 21.

As illustrated in FIG. 3A, as the driver 45 depicted in FIG. 2 moves the permanent magnet 26 downward in a direction D4 toward the fixing belt 21 and the magnetic member 24, the permanent magnet 26 exerts an increased magnetic attractive force on the magnetic member 24 against a biasing force of the tension spring 27 depicted in FIG. 2, thus moving the heat generator 23 together with the magnetic member 24 upward in the direction D3. Simultaneously, the heat generator 23 presses against the fixing belt 21 with an increased pressure or, if separated from the fixing belt 21, is disposed opposite the fixing belt 21 with a decreased distance between the heat generator 23 and the fixing belt 21, thus improving heat conductivity from the heat generator 23 to the fixing belt 21, that is, activating heat conduction from the heat generator 23 to the fixing belt 21.

By contrast, as illustrated in FIG. 3B, as the driver 45 depicted in FIG. 2 moves the permanent magnet 26 upward in a direction D6 away from the fixing belt 21 and the magnetic member 24, the permanent magnet 26 exerts a decreased magnetic attractive force on the magnetic member 24 against a biasing force of the tension spring 27, thus moving the heat generator 23 together with the magnetic member 24 downward in the direction D5. Simultaneously, the heat generator 23 presses against the fixing belt 21 with a decreased pressure or is disposed opposite the fixing belt 21 with an increased distance between the heat generator 23 and the fixing belt 21. That is, the heat generator 23 is isolated from the fixing belt 21 with no pressure therebetween, thus degrading heat conductivity from the heat generator 23 to the fixing belt 21, that is, deactivating heat conduction from the heat generator 23 to the fixing belt 21.

Accordingly, instead of a moving mechanism including a cam that contacts and moves the heat generator 23, the fixing device 20 employs the permanent magnet 26 that moves the heat generator 23 by magnetic force without contacting the heat generator 23, preventing elements of the fixing device 20 other than the fixing belt 21 from drawing heat generated by the heat generator 23 and thereby maintaining heating efficiency of the fixing belt 21.

For example, even when the entire heat generator 23 does not contact the fixing belt 21, with a gap therebetween of about 0.2 mm or smaller, preferably about 0.1 mm or smaller, an air layer of the gap degrades heat conductivity to an extent that can be ignored, maintaining high heat conductivity from the heat generator 23 to the fixing belt 21. Accordingly, the driver 45 moves the permanent magnet 26 in such a manner that the position of the permanent magnet 26 is switchable between the two positions: a first position shown in FIG. 3A, where the permanent magnet 26 is disposed closer to the fixing belt 21 and the magnetic member 24 with a gap of about 0.2 mm or smaller, preferably about 0.1 mm or smaller, between the fixing belt 21 and the heat generator 23; and a second position shown in FIG. 3B, where the permanent magnet 26 is disposed away from the fixing belt 21 and the magnetic member 24 with a greater gap of at least 0.2 mm between the fixing belt 21 and the heat generator 23.

Optionally, the fixing device 20 may further include a stopper that restricts an amount of movement of the heat generator 23 moving upward in the direction D3 and downward in the direction D5 in accordance with movement of the permanent magnet 26 as described above, thus facilitating adjustment of the pressure with which the heat generator 23 presses against the fixing belt 21 or the distance between the heat generator 23 and the fixing belt 21 within a target range.

The moving assembly 60 that moves the heat generator 23 is controlled by the controller 6 depicted in FIG. 1 according to rotation of the fixing belt 21. For example, when the fixing belt 21 does not rotate, the moving assembly 60 moves the heat generator 23 to a position where the heat generator 23 presses against the fixing belt 21 with a pressure smaller than that when the fixing belt 21 rotates or to a position where the heat generator 23 is disposed opposite the fixing belt 21 with a distance greater than that when the fixing belt 21 rotates.

Specifically, when the fixing device 20 is warmed up or a recording medium P passes through the fixing device 20 and therefore the fixing belt 21 rotates clockwise in FIG. 2 in the rotation direction R1, the driver 45 moves the permanent magnet 26 to the first position shown in FIG. 3A where the permanent magnet 26 is disposed closer to the fixing belt 21, causing the heat generator 23 to contact the fixing belt 21 or causing the heat generator 23 to be disposed opposite the fixing belt 21 with a slight gap therebetween allowing heat conduction from the heat generator 23 to the fixing belt 21. Simultaneously, as the fixing belt 21 rotates clockwise in FIG. 2 in the rotation direction R1, a contact section on the inner circumferential surface of the fixing belt 21 where the fixing belt 21 contacts the heat generator 23 and is heated by the heat generator 23 moves in the circumferential direction of the fixing belt 21, resulting in efficient and uniform heating of the fixing belt 21 over the circumferential direction thereof.

Conversely, in a standby mode in which the fixing belt 21 does not rotate, the driver 45 moves the permanent magnet 26 to the second position shown in FIG. 3B where the permanent magnet 26 is disposed away from the fixing belt 21, thus isolating the heat generator 23 from the fixing belt 21 or separating the heat generator 23 from the fixing belt 21 with a substantial gap therebetween that prohibits heat conduction from the heat generator 23 to the fixing belt 21. Simultaneously, the fixing belt 21, although it does not rotate, is not heated by the heat generator 23 locally, preventing temperature variation of the fixing belt 21 in the circumferential direction thereof, that is, the rotation direction R1. Moreover, heat radiated from the heat generator 23 isolated from the fixing belt 21 sufficiently reaches the fixing belt 21 substantially uniformly over the circumferential direction of the fixing belt 21, thus heating the fixing belt 21 uniformly over the circumferential direction thereof although heating efficiency is degraded compared to when the heat generator 23 contacting the fixing belt 21 conducts heat to the fixing belt 21. Accordingly, even when a recording medium P is conveyed to the nip NP for the fixing process immediately after the standby mode is finished, faulty fixing does not occur due to variation in the temperature of the fixing belt 21 in the circumferential direction thereof.

In addition to the above-described control, even when the fixing belt 21 rotates after conveyance of the recording medium P through the nip NP is finished, the controller 6 controls the moving assembly 60 to move the heat generator 23 to the position where the heat generator 23 presses against the fixing belt 21 with a decreased pressure or is disposed opposite the fixing belt 21 with a greater distance therebetween compared to when conveyance of the recording medium P through the nip NP is ongoing.

For example, when the fixing process is performed at the nip NP while a recording medium P is conveyed through the nip NP or until the fixing process is finished on the last recording medium P when a plurality of recording media P is conveyed through the nip NP continuously, the driver 45 moves the permanent magnet 26 to the first position shown in FIG. 3A where the permanent magnet 26 is disposed closer to the fixing belt 21, causing the heat generator 23 to contact the fixing belt 21 or causing the heat generator 23 to be disposed opposite the fixing belt 21 with a slight gap therebetween allowing heat conduction from the heat generator 23 to the fixing belt 21. Simultaneously, as the fixing belt 21 rotates clockwise in FIG. 2 in the rotation direction R1, the contact section on the inner circumferential surface of the fixing belt 21 where the fixing belt 21 contacts the heat generator 23 and is heated by the heat generator 23 moves in the circumferential direction of the fixing belt 21, resulting in efficient and uniform heating of the fixing belt 21 over the circumferential direction thereof.

Conversely, immediately after the fixing process is finished at the nip NP while a recording medium P is conveyed through the nip NP or immediately after the fixing process is finished on the last recording medium P when a plurality of recording media P is conveyed through the nip NP continuously, the driver 45 moves the permanent magnet 26 to the second position shown in FIG. 3B where the permanent magnet 26 is disposed away from the fixing belt 21, thus isolating the heat generator 23 from the fixing belt 21 or moving the heat generator 23 downward in the direction D5 to the position where the heat generator 23 presses against the fixing belt 21 with a slight pressure of about 0.1 $kgf/cm^2$ or smaller. Simultaneously, the fixing belt 21, although it rotates, does not contact the heat generator 23 or presses against it with the slight pressure therebetween, preventing deterioration or wear of the fixing belt 21 and the heat generator 23 and an increased torque of drivers installed in the fixing device 20 due to friction between the fixing belt 21 and the heat generator 23 that arises as the fixing belt 21 slides over the heat generator 23.

As described above, the configuration according to the first illustrative embodiment changes the pressure with which the heat generator 23 presses against the fixing belt 21 or the distance between the heat generator 23 and the fixing belt 21 disposed opposite the heat generator 23. Thus, even when the heat generator 23 presses against the fixing belt 21 or is disposed opposite the fixing belt 21 to heat the fixing belt 21, the heat generator 23 can heat the fixing belt 21 efficiently. Further, even when the fixing belt 21 does not rotate, temperature variation of the fixing belt 21 does not arise in the rotation direction R1 thereof.

Additionally, according to the first illustrative embodiment, the permanent magnet 26 generates an attractive force between the permanent magnet 26 and the magnetic member 24 and at the same time the tension spring 27 exerts a biasing force on the magnetic member 24 and the heat generator 23 downward in FIG. 2 in the direction D2 to separate the heat generator 23 from the fixing belt 21. Alternatively, the permanent magnet 26 may generate a repulsive force between the permanent magnet 26 and the magnetic member 24 and at the same time a biasing member (e.g., a compression spring) may exert a biasing force (e.g., a compressive force) on the magnetic member 24 and the heat generator 23 upward in FIG. 2 in a direction opposite the direction D2 to move the heat generator 23 closer to the fixing belt 21, thus attaining effects equivalent to the effects of the first illustrative embodiment.

Further, the configuration according to the first illustrative embodiment uses the permanent magnet 26 as a magnet that slidably moves over the frame of the fixing device 20 in the diametrical direction of the fixing belt 21 and exerts a magnetic force on the magnetic member 24 to cause the heat generator 23 to contact and separate from the fixing belt 21 or change pressure with which the heat generator 23 presses against the fixing belt 21. Alternatively, an electromagnet or a superconducting magnet may be used as a magnet that exerts a magnetic force on the magnetic member 24. Such magnets can also slidably move to cause the heat generator 23 to contact and separate from the fixing belt 21 or change pressure with which the heat generator 23 presses against the fixing belt 21, thus attaining effects equivalent to the effects of the first illustrative embodiment.

Figure 4:
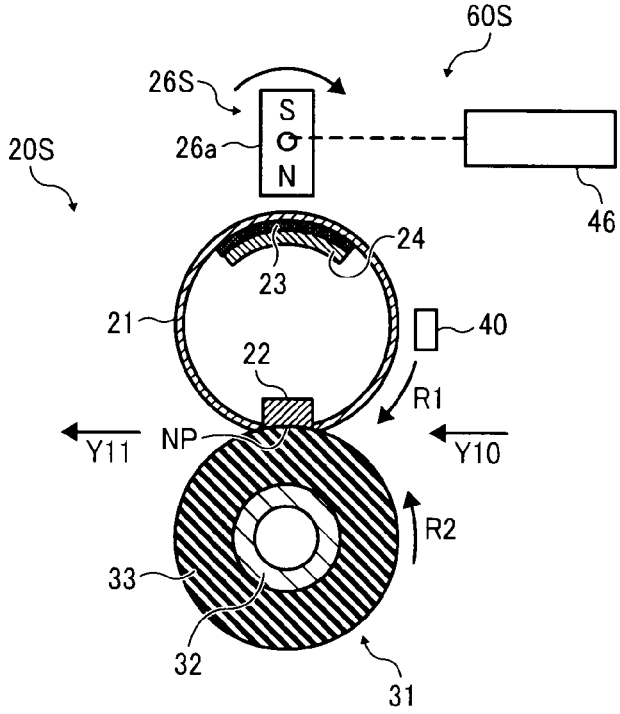
FIG. 4 is a vertical sectional view of a fixing device according to another exemplary embodiment of the present invention.
Figure 5A:
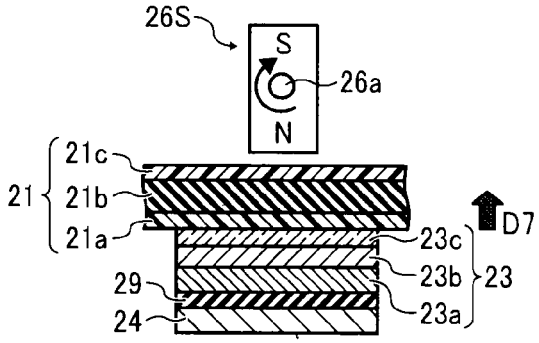
FIG. 5A is a partially enlarged vertical sectional view of the fixing belt included in the fixing device shown in FIG. 4 in a state in which the fixing belt is rotated.
Figure 5B:
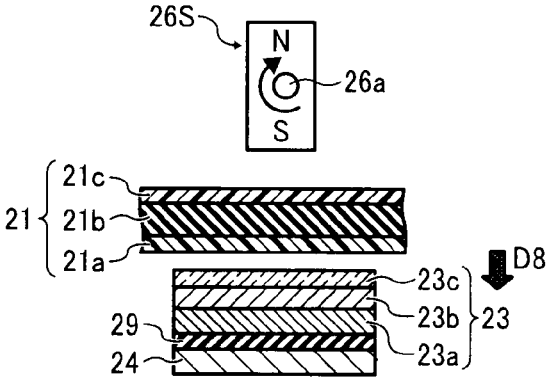
FIG. 5B is a partially enlarged vertical sectional view of the fixing belt included in the fixing device shown in FIG. 4 in a state in which the fixing belt is not rotated.

Referring to FIGS. 4, 5A, and 5B, the following describes a fixing device 20S according to a second illustrative embodiment.

FIG. 4 is a vertical sectional view of the fixing device 20S. FIG. 5A is a partially enlarged vertical sectional view of the fixing belt 21 of the fixing device 20 in a state in which the fixing belt 21 is rotated. FIG. 5B is a partially enlarged vertical sectional view of the fixing belt 21 in a state in which the fixing belt 21 is not rotated. Instead of the permanent magnet 26 depicted in FIG. 2 of the fixing device 20 according to the first illustrative embodiment, which is slidably movable, the fixing device 20S according to the second illustrative embodiment includes a permanent magnet 26S that is rotatably movable.

As illustrated in FIGS. 4, 5A, and 5B, like the fixing device 20 according to the first illustrative embodiment shown in FIG. 2, the fixing device 20S according to the second illustrative embodiment includes the fixing belt 21 formed into a loop; the nip formation pad 22, the heat generator 23, and the magnetic member 24, which are disposed inside the loop formed by the fixing belt 21; and the permanent magnet 26S, the pressing roller 31, the temperature sensor 40, and a driver 46, which are disposed outside the loop formed by the fixing belt 21.

The fixing device 20S further includes a moving assembly 60S that moves the heat generator 23 combined with the magnetic member 24 and the insulator 29 to change pressure with which the heat generator 23 presses against the fixing belt 21 or a distance between the heat generator 23 and the fixing belt 21 disposed opposite the heat generator 23.

For example, the moving assembly 60S includes the permanent magnet 26S, the magnetic member 24, and the driver 46 that drives and rotates the permanent magnet 26S.

The permanent magnet 26S, disposed opposite the magnetic member 24 via the fixing belt 21 and the heat generator 23, is rotated about a rotary shaft 26*a* by the driver 46 to change the magnetic pole, that is, the north pole or the south pole, of the permanent magnet 26S disposed opposite the magnetic member 24. The magnetic member 24, together with the insulator 29 depicted in FIG. 5A, is adhered to the heat generator 23 in such a manner that the magnetic member 24 is disposed opposite the fixing belt 21 via the insulator 29 and the heat generator 23.

With this configuration, when the fixing belt 21 rotates, the driver 46 depicted in FIG. 4 rotates the permanent magnet 26S to a first position shown in FIG. 5A where the north pole of the permanent magnet 26S is disposed opposite the fixing belt 21 and the magnetic member 24; thus, the permanent magnet 26S exerts a magnetic attractive force on the magnetic member 24, which moves the heat generator 23, together with the magnetic member 24, upward in a direction D7 as shown in FIG. 5A. Simultaneously, the heat generator 23 presses against the fixing belt 21 with an increased pressure or is disposed opposite the fixing belt 21 with a decreased distance therebetween, improving heat conducting efficiency from the heat generator 23 to the fixing belt 21.

By contrast, when the fixing belt 21 does not rotate, the driver 46 rotates the permanent magnet 26S to a second position shown in FIG. 5B where the south pole of the permanent magnet 26S is disposed opposite the fixing belt 21 and the magnetic member 24; thus, the permanent magnet 26S exerts a magnetic repulsive force on the magnetic member 24, which moves the heat generator 23, together with the magnetic member 24, downward in a direction D8 as shown in FIG. 5B. Simultaneously, the heat generator 23 presses against the fixing belt 21 with a decreased pressure or is disposed opposite the fixing belt 21 with an increased distance therebetween, that is, the heat generator 23 separates from the fixing belt 21, rendering pressure between the heat generator 23 and the fixing belt 21 to zero. Accordingly, the fixing belt 21, which is heated by heat conduction from the heat generator 23, is now heated by heat radiation from the heat generator 23, thus minimizing localized overheating of the fixing belt 21 while the fixing belt 21 does not rotate.

It is to be noted that, according to the second illustrative embodiment, the south pole of the magnetic member 24 is disposed opposite the permanent magnet 26S.

According to the second illustrative embodiment, since the permanent magnet 26S biases the magnetic member 24 and the heat generator 23 attached to the magnetic member 24 by its magnetic repulsive force to separate the heat generator 23 from the fixing belt 21, the tension spring 27 of the fixing device 20 according to the first illustrative embodiment shown in FIG. 2 is not attached to the magnetic member 24. Alternatively, the tension spring 27 may be attached to the magnetic member 24 to add a supplementary biasing force that separates the heat generator 23 and the magnetic member 24 from the fixing belt 21.

As described above, like the configuration according to the first illustrative embodiment, the configuration according to the second illustrative embodiment changes the pressure with which the heat generator 23 presses against the fixing belt 21 or the distance between the heat generator 23 and the fixing belt 21 disposed opposite the heat generator 23. Thus, even when the heat generator 23 presses against the fixing belt 21 or is disposed opposite the fixing belt 21 to heat the fixing belt 21, the heat generator 23 can heat the fixing belt 21 efficiently. Further, even when the fixing belt 21 does not rotate, temperature variation of the fixing belt 21 does not arise in the rotation direction R1 thereof.

Figure 6:
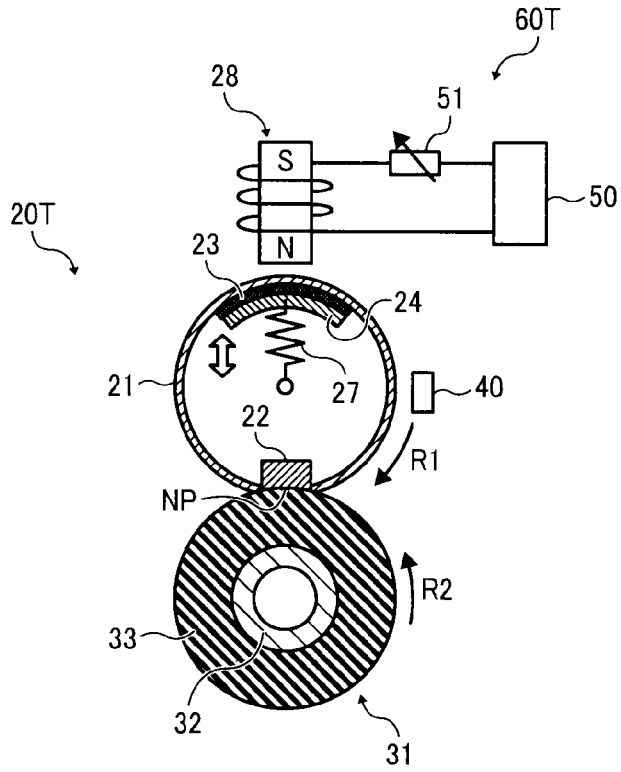
FIG. 6 is a vertical sectional view of a fixing device according to yet another exemplary embodiment of the present invention.
Figure 7:
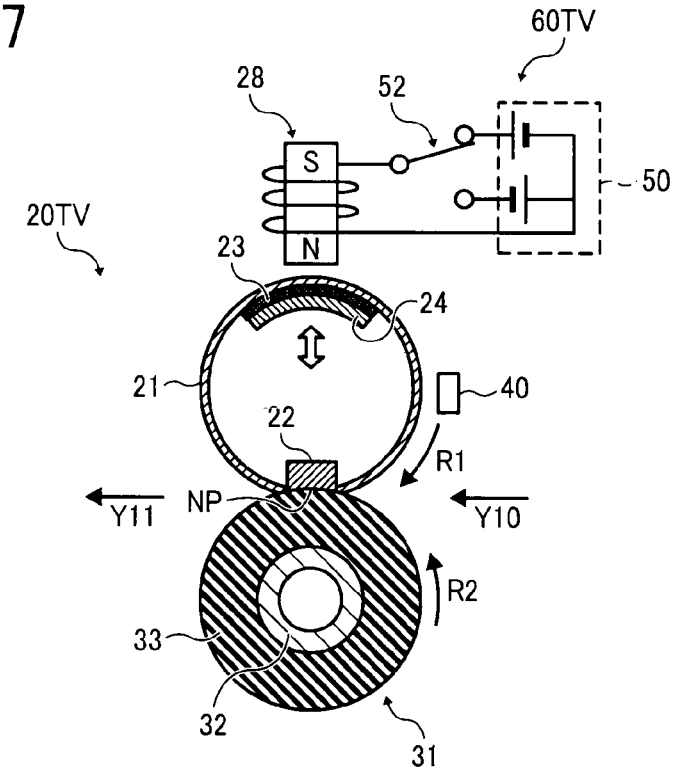
FIG. 7 is a vertical sectional view of a fixing device as a variation of the fixing device shown in FIG. 6.

Referring to FIGS. 6 and 7, the following describes a fixing device 20T according to a third illustrative embodiment and a fixing device 20TV as a variation of the fixing device 20T.

FIG. 6 is a vertical sectional view of the fixing device 20T. FIG. 7 is a vertical sectional view of the fixing device 20TV as a variation of the fixing device 20T shown in FIG. 6. Instead of the permanent magnet 26 depicted in FIG. 2 of the fixing device 20 according to the first illustrative embodiment, the fixing devices 20T and 20TV according to the third illustrative embodiment include an electromagnet 28.

As illustrated in FIG. 6, like the fixing device 20 according to the first illustrative embodiment shown in FIG. 2, the fixing device 20T according to the third illustrative embodiment includes the fixing belt 21 formed into a loop; the nip formation pad 22, the heat generator 23, the magnetic member 24, and the tension spring 27, which are disposed inside the loop formed by the fixing belt 21; and the electromagnet 28, the pressing roller 31, the temperature sensor 40, a power source 50, and a variable resistor 51, which are disposed outside the loop formed by the fixing belt 21.

The fixing device 20T further includes a moving assembly 60T that moves the heat generator 23 combined with the magnetic member 24 and the insulator 29 depicted in FIG. 3A to change pressure with which the heat generator 23 presses against the fixing belt 21 or a distance between the heat generator 23 and the fixing belt 21 disposed opposite the heat generator 23.

For example, the moving assembly 60T includes the electromagnet 28, the magnetic member 24, the tension spring 27, the power source 50, and the variable resistor 51.

The electromagnet 28 is disposed opposite the magnetic member 24 via the fixing belt 21 and the heat generator 23. The variable resistor 51 changes an amount of electric current applied to the electromagnet 28 (e.g., an electromagnetic coil) from the power source 50 to change a magnetic force exerted on the magnetic member 24. The magnetic member 24, together with the insulator 29 depicted in FIG. 3A, is adhered to the heat generator 23 in such a manner that the magnetic member 24 is disposed opposite the fixing belt 21 via the insulator 29 and the heat generator 23.

With this configuration, when the fixing belt 21 rotates, the controller 6 depicted in FIG. 1 controls the variable resistor 51 to supply an increased amount of electric current from the power source 50 to the electromagnet 28; thus, the electromagnet 28 exerts an increased magnetic attractive force on the magnetic member 24 against a biasing force of the tension spring 27, moving the heat generator 23, together with the magnetic member 24, upward in FIG. 6. Simultaneously, the heat generator 23 presses against the fixing belt 21 with an increased pressure or is disposed opposite the fixing belt 21 with a decreased distance therebetween, improving heat conducting efficiency from the heat generator 23 to the fixing belt 21.

By contrast, when the fixing belt 21 does not rotate, the controller 6 controls the variable resistor 51 to supply a decreased amount of electric current from the power source 50 to the electromagnet 28; thus, the electromagnet 28 exerts a decreased magnetic attractive force on the magnetic member 24, moving the heat generator 23, together with the magnetic member 24, downward in FIG. 6 with a biasing force of the tension spring 27. Simultaneously, the heat generator 23 presses against the fixing belt 21 with a decreased pressure or is disposed opposite the fixing belt 21 with an increased distance therebetween, that is, the heat generator 23 separates from the fixing belt 21, rendering pressure between the heat generator 23 and the fixing belt 21 to zero. Accordingly, the fixing belt 21, which is heated by heat conduction from the heat generator 23, is now heated by heat radiation from the heat generator 23, thus minimizing localized overheating of the fixing belt 21 while the fixing belt 21 does not rotate.

According to the above-described fixing device 20T according to the third illustrative embodiment, the controller 6 controls the variable resistor 51 to change the amount of electric current supplied from the power source 50 to the electromagnet 28, thus causing the heat generator 23 to contact and separate from the fixing belt 21. Alternatively, the controller 6 may change a direction in which the electric current is applied to the electromagnet 28 to change the magnetic pole thereof, that is, the north pole or the south pole, which exerts a magnetic force on the magnetic member 24, thus causing the heat generator 23 to contact and separate from the fixing belt 21.

For example, as illustrated in FIG. 7, the electromagnet 28 is disposed opposite the magnetic member 24 via the fixing belt 21 and the heat generator 23. Instead of the variable resistor 51 shown in FIG. 6, the fixing device 20TV includes a switching circuit 52 that changes the direction in which the power source 50 applies the electric current to the electromagnet 28, thus changing the magnetic polarity of the electromagnet 28 that exerts a magnetic force on the magnetic member 24.

As illustrated in FIG. 7, the fixing device 20TV as a variation of the fixing device 20T according to the third illustrative embodiment includes the fixing belt 21 formed into a loop; the nip formation pad 22, the heat generator 23, and the magnetic member 24, which are disposed inside the loop formed by the fixing belt 21; and the electromagnet 28, the pressing roller 31, the temperature sensor 40, the power source 50, and the switching circuit 52, which are disposed outside the loop formed by the fixing belt 21.

The fixing device 20TV further includes a moving assembly 60TV that moves the heat generator 23 combined with the magnetic member 24 and the insulator 29 depicted in FIG. 3A to change pressure with which the heat generator 23 presses against the fixing belt 21 or a distance between the heat generator 23 and the fixing belt 21 disposed opposite the heat generator 23.

For example, the moving assembly 60TV includes the electromagnet 28, the magnetic member 24, the power source 50, and the switching circuit 52.

With this configuration, when the fixing belt 21 rotates, the controller 6 depicted in FIG. 1 controls the switching circuit 52 to change the direction in which the power source 50 applies the electric current to the electromagnet 28, causing the north pole of the electromagnet 28 to be disposed opposite the fixing belt 21 and the magnetic member 24; thus, the electromagnet 28 exerts a magnetic attractive force on the magnetic member 24, moving the heat generator 23, together with the magnetic member 24, upward in FIG. 7. Simultaneously, the heat generator 23 presses against the fixing belt 21 with an increased pressure or is disposed opposite the fixing belt 21 with a decreased distance therebetween, improving heat conducting efficiency from the heat generator 23 to the fixing belt 21.

By contrast, when the fixing belt 21 does not rotate, the controller 6 controls the switching circuit 52 to change the direction in which the power source 50 applies the electric current to the electromagnet 28, causing the south pole of the electromagnet 28 to be disposed opposite the fixing belt 21 and the magnetic member 24; thus, the electromagnet 28 exerts a magnetic repulsive force on the magnetic member 24, moving the heat generator 23, together with the magnetic member 24, downward in FIG. 7. Simultaneously, the heat generator 23 presses against the fixing belt 21 with a decreased pressure or is disposed opposite the fixing belt 21 with an increased distance therebetween, that is, the heat generator 23 separates from the fixing belt 21, rendering pressure between the heat generator 23 and the fixing belt 21 to zero. Accordingly, the fixing belt 21, which is heated by heat conduction from the heat generator 23, is now heated by heat radiation from the heat generator 23, thus minimizing localized overheating of the fixing belt 21 while the fixing belt 21 does not rotate.

It is to be noted that, in the fixing devices 20T and 20TV, the south pole of the magnetic member 24 is disposed opposite the electromagnet 28.

As described above, like the configuration according to the above-described illustrative embodiments, the configurations according to the third illustrative embodiment and the variation thereof change the pressure with which the heat generator 23 presses against the fixing belt 21 or the distance between the heat generator 23 and the fixing belt 21 disposed opposite the heat generator 23. Thus, even when the heat generator 23 presses against the fixing belt 21 or is disposed opposite the fixing belt 21 to heat the fixing belt 21, the heat generator 23 can heat the fixing belt 21 efficiently. Further, even when the fixing belt 21 does not rotate, temperature variation of the fixing belt 21 does not arise in the rotation direction R1 thereof.

Figure 8:
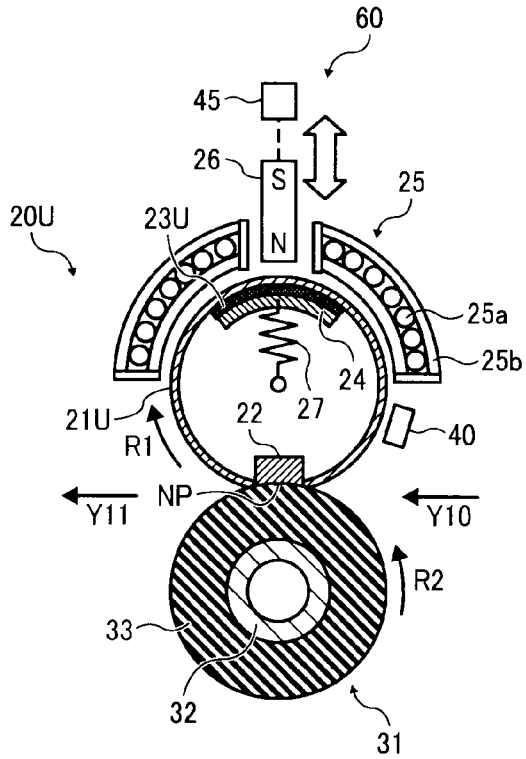
FIG. 8 is a vertical sectional view of a fixing device according to yet another exemplary embodiment of the present invention.
Figure 9A:
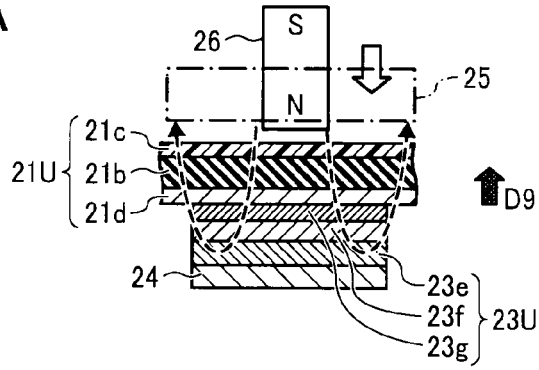
FIG. 9A is a partially enlarged vertical sectional view of a fixing belt included in the fixing device shown in FIG. 8 in a state in which the fixing belt is rotated.
Figure 9B:
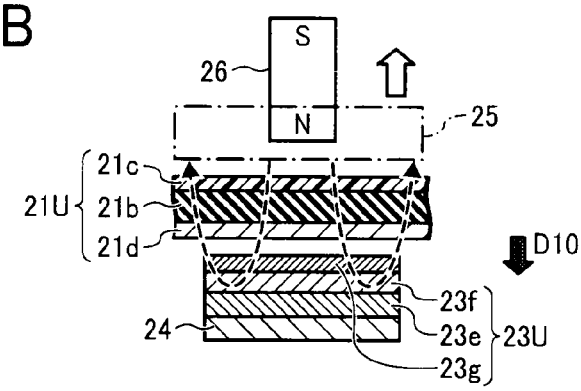
FIG. 9B is a partially enlarged vertical sectional view of the fixing belt included in the fixing device shown in FIG. 8 in a state in which the fixing belt is not rotated.

Referring to FIGS. 8, 9A, and 9B, the following describes a fixing device 20U according to a fourth illustrative embodiment.

FIG. 8 is a vertical sectional view of the fixing device 20U. FIG. 9A is a partially enlarged vertical sectional view of a fixing belt 21U installed in the fixing device 20U in a state in which it is rotated. FIG. 9B is a partially enlarged vertical sectional view of the fixing belt 21U in a state in which it is not rotated. Unlike the fixing device 20 depicted in FIG. 2 according to the first illustrative embodiment in which the heat generator 23 generates heat by its resistance, the fixing device 20U according to the fourth illustrative embodiment has the configuration in which a heat generator 23U is heated by an exciting coil unit 25 by electromagnetic induction.

As illustrated in FIG. 8, the fixing device 20U includes the fixing belt 21U faulted into a loop; the nip formation pad 22, the heat generator 23U, the magnetic member 24, and the tension spring 27, which are disposed inside the loop formed by the fixing belt 21U; and the permanent magnet 26, the driver 45, the pressing roller 31, the temperature sensor 40, and the exciting coil unit 25, which are disposed outside the loop formed by the fixing belt 21U.

Like the fixing device 20 according to the first illustrative embodiment depicted in FIG. 2, the fixing device 20U further includes the moving assembly 60 that moves the heat generator 23U combined with the magnetic member 24 and the insulator 29 depicted in FIG. 3A to change pressure with which the heat generator 23U presses against the fixing belt 21U or a distance between the heat generator 23U and the fixing belt 21U disposed opposite the heat generator 23U. For example, the moving assembly 60 includes the permanent magnet 26, the magnetic member 24, the tension spring 27, and the driver 45.

The exciting coil unit 25, serving as an induction heater, includes an exciting coil 25*a* and an exciting coil core 25*b*. The exciting coil 25*a*, extending in a longitudinal direction of the exciting coil unit 25 parallel to the axial direction of the fixing belt 21U, is constructed of litz wire formed by bundling thin wire and wound around the exciting coil core 25*b* that covers a part of an outer circumferential surface of the fixing belt 21U. The exciting coil core 25*b*, made of ferromagnet (e.g., ferrite) having a relative permeability of about 2,500, generates a magnetic flux toward a heat generation layer of the fixing belt 21U and a heat generation layer of the heat generator 23U efficiently.

Referring to FIG. 9A, a detailed description is now given of the fixing belt 21U.

The fixing belt 21U is constructed of three layers: a base layer 21*d* constituting an inner circumferential surface of the fixing belt 21U, that is, a contact face that slides over the nip formation pad 22 and the heat generator 23U; the elastic layer 21*b* disposed on the base layer 21*d*; and the release layer 21*c* disposed on the elastic layer 21*b*.

For example, the base layer 21*d*, having a thickness of from about several microns to about several hundred microns, is made of a magnetic material, such as SUS420 stainless steel or Fe—Ni alloy, thus serving as a heat generation layer heated by the exciting coil unit 25 by electromagnetic induction. The configuration of the elastic layer 21*b* and the release layer 21*c* of the fixing belt 21U is identical to that of the fixing belt 21 depicted in FIG. 2 installed in the fixing device 20 according to the first illustrative embodiment.

Referring to FIG. 9A, a detailed description is now given of the heat generator 23U.

The heat generator 23U is constructed of three layers like the heat generator 23 of the fixing device 20 shown in FIG. 3A, however, the configuration of the three layers is different from that of the heat generator 23. For example, the heat generator 23U includes an antioxidant layer 23*e* constituting an inner circumferential surface of the heat generator 23U, that is, an opposed face disposed opposite the magnetic member 24; a heat generation layer 23*f* disposed on the antioxidant layer 23*e*; and an antioxidant layer 23*g* disposed on the heat generation layer 23*f*.

The heat generation layer 23*f*, having a thickness of about 10 μm, is made of copper. As an exciting magnetic flux generated by the exciting coil unit 25 passes through the heat generation layer 23*f*, it induces an eddy current that heats the heat generation layer 23*f* by electromagnetic induction.

Each of the antioxidant layers 23*e* and 23*g*, having a thickness of about 30 μm, is made of nickel plate; the antioxidant layers 23*e* and 23*g* sandwich the heat generation layer 23*f*, inhibiting oxidation of the heat generation layer 23*f*.

With this configuration, the heat generator 23U is heated by electromagnetic induction by an alternating magnetic field generated by the exciting coil unit 25, thus heating the fixing belt 21U contacting the heat generator 23U. That is, the exciting coil unit 25 heats the heat generator 23U directly by electromagnetic induction and heats the fixing belt 21U indirectly via the heat generator 23U by heat conduction from the heat generator 23U to the fixing belt 21U.

Further, since the fixing belt 21U has the base layer 21*d* that functions as a heat generation layer, the fixing belt 21U itself, that is, the base layer 21*d*, is also heated directly by electromagnetic induction by the alternating magnetic field generated by the exciting coil unit 25. That is, the fixing belt 21U is heated directly by electromagnetic induction by the exciting coil unit 25 and at the same time is heated indirectly by the exciting coil unit 25 by heat conduction from the heat generator 23U heated by electromagnetic induction by the exciting coil unit 25, improving heating efficiency of the fixing belt 21U.

Thereafter, the heated fixing belt 21U heats a recording medium P bearing a toner image T.

The controller 6 depicted in FIG. 1 controls output of the exciting coil unit 25 based on a detection result provided from the temperature sensor 40 disposed opposite the outer circumferential surface of the fixing belt 21U to detect a temperature thereof, thus adjusting the temperature of the fixing belt 21U to a desired fixing temperature.

Referring to FIGS. 1 and 8, the following describes the operation of the fixing device 20U having the above-described configuration.

When the image forming apparatus 1 is powered on, a high-frequency power source supplies an alternating electric current to the exciting coil 25*a* of the exciting coil unit 25, and at the same time the pressing roller 31 starts rotating in the rotation direction R2. Accordingly, the fixing belt 21U rotates in accordance with rotation of the pressing roller 31 in the rotation direction R1 counter to the rotation direction R2 of the pressing roller 31 due to friction therebetween at the nip NP.

Thereafter, at the transfer nip formed between the photoconductive drum 5 and the transfer device 7, the toner image T formed on the photoconductive drum 5 as described above is transferred onto a recording medium P sent from one of the paper trays 12, 13, and 14. The recording medium P bearing the toner image T is conveyed from the transfer nip in the direction Y10 toward the nip NP, entering the nip NP formed between the fixing belt 21U and the pressing roller 31 pressed against each other.

As the recording medium P bearing the toner image T passes through the nip NP, it receives heat from the heated fixing belt 21U and pressure from the fixing belt 21U, the nip formation pad 22, and the pressing roller 31 that form the nip NP. Thus, the toner image T is fixed on the recording medium P by the heat and the pressure applied at the nip NP. Thereafter, the recording medium P bearing the fixed toner image T is discharged from the nip NP and conveyed in the direction Y11.

With the above-described configuration of the fixing device 20U shown in FIGS. 8, 9A, and 9B, when the fixing belt 21U rotates, the driver 45 moves the permanent magnet 26 to a first position shown in FIG. 9A where the permanent magnet 26 is disposed closer to the fixing belt 21U, thus increasing a magnetic attractive force of the permanent magnet 26 exerted on the magnetic member 24 against a biasing force of the tension spring 27, which moves the heat generator 23U, together with the magnetic member 24, upward in a direction D9. Simultaneously, the heat generator 23U presses against the fixing belt 21U with an increased pressure or is disposed opposite the fixing belt 21U with a decreased distance therebetween, thus improving heat conductivity from the heat generator 23U to the fixing belt 21U.

By contrast, when the fixing belt 21U does not rotate, the driver 45 moves the permanent magnet 26 to a second position shown in FIG. 9B where the permanent magnet 26 is disposed away from the fixing belt 21U, thus decreasing a magnetic attractive force of the permanent magnet 26 exerted on the magnetic member 24 and moving the heat generator 23U, together with the magnetic member 24, downward in a direction D10 with a biasing force of the tension spring 27. Simultaneously, the heat generator 23U presses against the fixing belt 21U with a decreased pressure or is disposed opposite the fixing belt 21U with an increased distance therebetween, that is, the heat generator 23U separates from the fixing belt 21U, rendering pressure between the heat generator 23U and the fixing belt 21U to zero. Accordingly, the fixing belt 21U, which is heated by heat conduction from the heat generator 23U, is now heated by heat radiation from the heat generator 23U, thus minimizing localized overheating of the fixing belt 21U while the fixing belt 21U does not rotate.

Even when the heat generator 23U is isolated from the fixing belt 21U, it is constantly disposed within a magnetic field indicated by the broken line in FIGS. 9A and 9B, which is generated by the exciting coil unit 25. Accordingly, the fixing belt 21U is heated precisely both during rotation and non-rotation. For example, while the fixing belt 21U rotates, it is heated by heat conduction from the heat generator 23U; while the fixing belt 21U does not rotate, it is heated by heat radiation from the heat generator 23U.

Preferably, the heat generation layer 23*f* of the heat generator 23U may be made of a magnetic shunt alloy.

For example, the base layer 21*d*, that is, the heat generation layer, of the fixing belt 21U is made of a ferromagnetic, magnetic shunt alloy such as iron, nickel, cobalt, or an alloy of these.

With such materials of the heat generation layer 23*f* of the heat generator 23U and the base layer 21*d* of the fixing belt 21U, the base layer 21*d* of the fixing belt 21U has a Curie temperature near an upper temperature limit of the fixing temperature with which the toner image T is fixed on the recording medium P, preventing overheating of the fixing belt 21U with self temperature control of the magnetic shunt alloy and thereby minimizing thermal degradation of the fixing belt 21U. Further, the base layer 21*d* of the fixing belt 21U has a Curie temperature equivalent to a temperature that maintains magnetic permeability against the heated magnetic member 24, rendering the insulator 29 disposed between the heat generator 23U and the magnetic member 24 unnecessary.

According to the fourth illustrative embodiment, the fixing belt 21U includes the heat generation layer, that is, the base layer 21*d*, heated by the exciting coil unit 25 by electromagnetic induction. Alternatively, the fixing belt 21U may not include the heat generation layer. For example, the fixing belt 21U is heated solely by the heat generator 23U by heat conduction or heat radiation, which is heated by the exciting coil unit 25 by electromagnetic induction, thus further enhancing prevention of localized overheating of the fixing belt 21U when the fixing belt 21U does not rotate.

As described above, like the configuration according to the above-described illustrative embodiments, the configuration according to the fourth illustrative embodiment changes the pressure with which the heat generator 23U presses against the fixing belt 21U or the distance between the heat generator 23U and the fixing belt 21U disposed opposite the heat generator 23U. Thus, even when the heat generator 23U presses against the fixing belt 21U or is disposed opposite the fixing belt 21U to heat the fixing belt 21U, the heat generator 23U can heat the fixing belt 21U efficiently. Further, even when the fixing belt 21U does not rotate, temperature variation of the fixing belt 21U does not arise in the rotation direction R1 thereof.

According to the above-described exemplary embodiments, the fixing belts 21 and 21U are used as a fixing rotary body that rotates in the predetermined direction of rotation; the pressing roller 31 is used as a pressing rotary body disposed opposite the fixing rotary body to form the nip NP therebetween and rotating in the direction counter to the direction of rotation of the fixing rotary body. Alternatively, a fixing film, a fixing roller, or the like may be used as a fixing rotary body; a pressing belt or the like may be used as a pressing rotary body, attaining effects equivalent to the effects of the fixing devices 20, 20S, 20T, 20TV, and 20U according to the above-described exemplary embodiments.

Further, the fixing devices 20, 20S, 20T, 20TV, and 20U according to the above-described exemplary embodiments are installed in the image forming apparatus 1 serving as a monochrome copier. Alternatively, they may be installed in color image forming apparatuses such as copiers, printers, facsimile machines, and multifunction printers having at least one of copying, printing, scanning, plotter, and facsimile functions, or the like.

Further, according to the above-described exemplary embodiments, the fixing devices 20, 20S, 20T, and 20TV include the heat generator 23 that generates heat; the fixing device 20U includes the heat generator 23U heated by the exciting coil unit 25 by electromagnetic induction. Alternatively, the fixing devices 20, 20S, 20T, 20TV, and 20U may include a heat generator heated by a heater (e.g., a halogen heater) by radiant heat, attaining effects equivalent to the effects of the fixing devices 20, 20S, 20T, 20TV, and 20U according to the above-described exemplary embodiments.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body to rotate in a predetermined direction of rotation;

a pressing rotary body pressed against the fixing rotary body to rotate in a direction counter to the direction of rotation of the fixing rotary body and form a nip therebetween through which a recording medium bearing a toner image passes;

a heat generator disposed opposite the fixing rotary body at a section other than the nip to heat the fixing rotary body; and a moving assembly disposed opposite the heat generator to generate a magnetic force to move the heat generator with respect to the fixing rotary body so as to change one of a pressure and a distance between the heat generator and the fixing rotary body, wherein the moving assembly includes:

a magnetic member attached to the heat generator and disposed opposite the fixing rotary body via the heat generator;

a permanent magnet disposed opposite the magnetic member via the fixing rotary body and the heat generator to exert a force on the magnetic member;

a biasing member attached to the magnetic member to exert force on the magnetic member that urges the magnetic member relative to the fixing rotary body against the force exerted by the permanent magnet; and a driver to move the permanent magnet against the force exerted by the biasing member to change a distance between the permanent magnet and the magnetic member.

2. The fixing device according to claim 1, wherein:

the permanent magnet disposed opposite the magnetic member via the fixing rotary body and the heat generator exerts an attractive force on the magnetic member;

the biasing member attached to the magnetic member exerts to exert tension on the magnetic member that pulls the magnetic member away from the fixing rotary body against the attractive force exerted by the permanent magnet; and the driver to move the permanent magnet moves the permanent magnet against the tension exerted by the biasing member to change the distance between the permanent magnet and the magnetic member.

3. The fixing device according to claim 2, wherein the magnetic member is made of hard ferrite.

4. The fixing device according to claim 2, further comprising an insulator disposed between the heat generator and the magnetic member.

5. The fixing device according to claim 1, wherein:

the permanent magnet disposed opposite the magnetic member via the fixing rotary body and the heat generator exerts a repulsive force on the magnetic member;

the biasing member attached to the magnetic member exerts a compressive force on the magnetic member that presses the magnetic member against the fixing rotary body against the repulsive force exerted by the permanent magnet; and the driver to move the permanent magnet moves the permanent magnet against the compressive force exerted by the biasing member to change the distance between the permanent magnet and the magnetic member.

6. The fixing device according to claim 1, wherein the heat generator includes a resistance heat generator.

7. The fixing device according to claim 1, further comprising an exciting coil unit disposed opposite the heat generator via the fixing rotary body to heat the heat generator by electromagnetic induction.

8. The fixing device according to claim 7, wherein the heat generator is made of a magnetic shunt alloy.

9. The fixing device according to claim 7, wherein the heat generator is disposed in a magnetic field generated by the exciting coil unit.

10. An image forming apparatus comprising the fixing device according to claim 1.

11. A fixing device comprising:

a fixing rotary body to rotate in a predetermined direction of rotation;

a pressing rotary body pressed against the fixing rotary body to rotate in a direction counter to the direction of rotation of the fixing rotary body and form a nip therebetween through which a recording medium bearing a toner image passes;

a heat generator disposed opposite the fixing rotary body at a section other than the nip to heat the fixing rotary body; and a moving assembly disposed opposite the heat generator to generate a magnetic force to move the heat generator with respect to the fixing rotary body so as to change one of a pressure and a distance between the heat generator and the fixing rotary body, wherein the moving assembly includes:

a magnetic member attached to the heat generator and disposed opposite the fixing rotary body via the heat generator;

a permanent magnet disposed opposite the magnetic member via the fixing rotary body and the heat generator to exert a magnetic force on the magnetic member; and a driver to rotate the permanent magnet to change a magnetic pole of the permanent magnet disposed opposite the magnetic member.

12. A fixing device comprising:

a fixing rotary body to rotate in a predetermined direction of rotation;

a pressing rotary body pressed against the fixing rotary body to rotate in a direction counter to the direction of rotation of the fixing rotary body and form a nip therebetween through which a recording medium bearing a toner image passes;

a heat generator disposed opposite the fixing rotary body at a section other than the nip to heat the fixing rotary body; and a moving assembly disposed opposite the heat generator to generate a magnetic force to move the heat generator with respect to the fixing rotary body so as to change one of a pressure and a distance between the heat generator and the fixing rotary body, wherein the moving assembly includes:

a magnetic member attached to the heat generator and disposed opposite the fixing rotary body via the heat generator;

an electromagnet disposed opposite the magnetic member via the fixing rotary body and the heat generator to exert a magnetic force on the magnetic member;

a power source connected to the electromagnet to supply power thereto; and a switching circuit connected to the power source and the electromagnet to change a direction of power supplied from the power source to the electromagnet so as to change a magnetic pole of the electromagnet disposed opposite the magnetic member.

13. A fixing device comprising:

a fixing rotary body to rotate in a predetermined direction of rotation;

a pressing rotary body pressed against the fixing rotary body to rotate in a direction counter to the direction of rotation of the fixing rotary body and form a nip therebetween through which a recording medium bearing a toner image passes;

a heat generator disposed opposite the fixing rotary body at a section other than the nip to heat the fixing rotary body; and a moving assembly disposed opposite the heat generator to generate a magnetic force to move the heat generator with respect to the fixing rotary body so as to change one of a pressure and a distance between the heat generator and the fixing rotary body, wherein the moving assembly includes:

a magnetic member attached to the heat generator and disposed opposite the fixing rotary body via the heat generator;

an electromagnet disposed opposite the magnetic member via the fixing rotary body and the heat generator to exert a force on the magnetic member;

a biasing member attached to the magnetic member to exert force on the magnetic member that urges the magnetic member relative to the fixing rotary body against the force exerted by the electromagnet;

a power source connected to the electromagnet to supply power thereto; and a variable resistor connected to the power source and the electromagnet to change an amount of power supplied from the power source to the electromagnet so as to change the force exerted by the electromagnet on the magnetic member.

14. The fixing device according to claim 13, wherein:

the electromagnet disposed opposite the magnetic member via the fixing rotary body and the heat generator exerts an attractive force on the magnetic member;

the biasing member attached to the magnetic member exerts tension on the magnetic member that pulls the magnetic member away from the fixing rotary body against the attractive force exerted by the electromagnet; and the variable resistor connected to the power source and the electromagnet changes an amount of power supplied from the power source to the electromagnet so as to change the attractive force exerted by the electromagnet on the magnetic member.

15. The fixing device according to claim 13, wherein:

the electromagnet disposed opposite the magnetic member via the fixing rotary body and the heat generator exerts a repulsive force on the magnetic member;

the biasing member attached to the magnetic member exerts a compressive force on the magnetic member that presses the magnetic member against the fixing rotary body against the repulsive force exerted by the electromagnet; and the variable resistor connected to the power source and the electromagnet changes an amount of power supplied from the power source to the electromagnet so as to change the repulsive force exerted by the electromagnet on the magnetic member.

* * * * *